US006360639B1

(12) United States Patent
Gerber

(10) Patent No.: US 6,360,639 B1
(45) **Date of Patent: *Mar. 26, 2002**

(54) RECIPROCATING KNIFE SHEET MATERIAL CUTTING APPARATUS WITH KNIFE SHARPENER

(75) Inventor: Heinz Joseph Gerber, West Hartford, CT (US)

(73) Assignee: Gerber Technology, Inc., Tolland, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/801,303

(22) Filed: Feb. 18, 1997

Related U.S. Application Data

(62) Division of application No. 08/380,968, filed on Jan. 31, 1995, now Pat. No. 6,131,498.

(51) Int. Cl.[7] ..... B26D 7/12; B26D 7/20

(52) U.S. Cl. ..... 83/174; 83/940; 451/423

(58) Field of Search ..... 83/174, 628, 632, 83/647, 528, 547, 597, 602, 821, 926, 940, 941, 698.11, 698.71, 779, 776, 646; 30/374, 393; 74/49, 570, 571 M; 451/45, 423, 419, 552, 556

(56) References Cited

U.S. PATENT DOCUMENTS 3,660,971 A * 5/1972 Hurlburt ..... 451/423 X
4,537,103 A * 8/1985 Flodin ..... 83/174
4,602,531 A * 7/1986 Korhonen ..... 451/45 X
4,643,061 A * 2/1987 Gerber ..... 83/174.1
4,732,064 A * 3/1988 Pearl ..... 83/13
4,762,040 A * 8/1988 Alcantara Perez et al. ..... 83/56
4,799,335 A * 1/1989 Battocchi ..... 451/45 X
4,829,721 A * 5/1989 Wright ..... 51/246
4,841,822 A * 6/1989 Gerber ..... 83/174
4,939,869 A * 7/1990 Stoll ..... 451/45
5,303,515 A * 4/1994 Etcheparre et al. ..... 83/174 X
5,505,108 A * 4/1996 Kuchta et al. ..... 83/940 X
5,626,065 A * 5/1997 Cattini ..... 83/174

FOREIGN PATENT DOCUMENTS

GB 422016 * 1/1935 ..... 451/423

* cited by examiner

*Primary Examiner*—M. Rachuba
*Assistant Examiner*—Charles Goodman
(74) *Attorney, Agent, or Firm*—McCormick, Paulding & Huber LLP

(57) ABSTRACT

A reciprocating knife cutter for performing a cutting operation on sheet material is provided wherein the knife is not limited to reciprocation along a vertical axis. The cutter includes a guide which engages the knife, whereby the knife and guide are constrained to slide relative to one another along the longitudinal axis of the knife. The knife is reciprocated by an eccentric drive mechanism in a plane perpendicular to the drive axis of the mechanism, and the guide is pivotally mounted on the cutter so that the knife and guide remain in engagement as the knife is reciprocated. A sheet material cutting apparatus including such a reciprocating cutter is also provided. The invention also provides a knife sharpener for a cutting apparatus.

2 Claims, 5 Drawing Sheets

RECIPROCATING KNIFE SHEET MATERIAL CUTTING APPARATUS WITH KNIFE SHARPENER

This is a divisional of co-pending application Ser. No. 08/380,968 filed on Jan. 31, 1995 U.S. Pat. No. 6,131,498, Oct. 17, 2000

BACKGROUND OF THE INVENTION

The present invention relates generally to reciprocating knife cutters of the type used for cutting pattern pieces or other parts from single ply or low ply sheet materials, such as fabric. More particularly, the present invention relates to a high speed reciprocating knife cutter wherein the knife is driven by an eccentric drive mechanism and a cutting apparatus utilizing such a knife cutter. The invention also relates to a knife sharpener for a cutting apparatus.

A reciprocating knife cutter of a type well-known in the art is shown, for example, in U.S. Pat. No. 4,879,935. The cutter disclosed therein includes a reciprocating knife driven by an eccentric mechanism. The knife is made as a one-piece member having a lower cutting portion supported by guide means for reciprocation along a vertical guide axis, and,an upper, resiliently flexible drive portion connected to the drive mechanism. The drive portion flexes laterally in a plane perpendicular to the drive axis of the eccentric mechanism, which permits the knife to be reciprocated along the vertical guide axis. The disadvantage of such a cutter is that a long, flexible knife blade is required which, due to the forces imposed on the flexible drive portion of the blade, has a relatively short service life.

A second type of reciprocating knife cutter well-known in the art is shown in U.S. Pat. No. 2,869,231. The cutter disclosed in this patent also includes an eccentric drive mechanism which reciprocates a knife along a vertical axis. However, in this case the knife is rigid and is driven by a connecting rod which links the top of the knife to the eccentric drive. The inclusion of an extra connecting rod and its associated hardware between the drive and the knife results in a bulky, relatively heavy device which cannot be operated efficiently at high speed. Moreover, the large number of moving parts present in such a device require constant maintenance.

A further disadvantage in many applications associated with both types of cutters described above is that reciprocation of the knife along a strictly vertical axis causes the knife to cut in both its downward and upward strokes as it passes though the sheet material. Cutting during the upward stroke of the knife tends to lift the sheet material from the horizontal surface on which it is supported in a spread condition during the cutting operation. Typically, the sheet material is held down against the support surface by vacuum applied from below. The tendency of the knife to lift the sheet material on the upstroke requires that more vacuum be applied to the material than would otherwise be required in order to insure that the material remains flat against the support surface during the cutting operation.

Cutting apparatus of the type discussed above, as well as butting apparatus in general, typically have an associated knife sharpener supported directly by the knife cutter. While such an arrangement places the sharpener in close proximity to the cutting blade for periodic sharpening between cutting operations, the sharpener adds weight to the knife cutter making it more difficult to overcome the inertial forces which tend to hinder rapid and precise movement of the cutter with respect to the sheet material being cut.

It is, therefore, an object of the invention to provide a high speed reciprocating knife cutter driven by an eccentric mechanism which does hot require either a resiliently flexible knife, or a connecting rod between the knife and the eccentric mechanism.

It is a further object of the invention to provide such a knife cutter which does not tend to lift the sheet material from the support surface during the upstroke of the knife.

It is a still further object of the invention to provide a knife cutter which provides for the use of an easily manipulated, low cost knife.

It is a yet another object of the invention to provide a knife sharpener for a cutting apparatus.

SUMMARY OF THE INVENTION

The present invention meets these and other objects by providing, in one aspect, a novel reciprocating knife cutter rich includes a frame, an eccentric drive member supported on the frame for rotation about a horizontal eccentric drive axis fixed relative to the frame, and an elongated knife having an upper part and a lower part which together define a longitudinal knife axis. The upper part of the knife is connected to the eccentric drive member for rotation therewith about the eccentric drive axis. The lower part of the knife has a sharpened cutting edge extending along at least a portion of its length, and means are provided for supporting the lower part of the knife for oscillation in a plane perpendicular to the eccentric drive axis. Means are also provided for slidably mounting the knife on the support means so that as the upper part of the knife is rotated and the knife reciprocates, the lower part of the knife oscillates and the knife and the support means slide relative to one another along the knife's longitudinal axis.

Since the knife is not reciprocated along a strictly vertical axis, but is instead reciprocated in a plane perpendicular to the drive axis, the cutting edge of the knife is caused to follow an arcuate trajectory. Accordingly, as the cutter is moved along a cutting path on sheet material supported in a spread condition beneath the cutter, the cutting edge of, the knife moves forward or reward with respect to the cutting path during the knife's downward stroke, depending on the direction in which the eccentric drive member rotates. Since the cutting action of the knife is increased when the cutting edge is moving forward with respect to the cutting path, the knife can selectively be made to cut more effectively on either its upward or downward stroke by controlling the direction in which the eccentric drive member rotates.

This provides a number of important advantages. By rotating the drive member so that the knife cuts primarily on its downward stroke, the problem of the knife lifting the sheet material from the support surface on its upward stroke can be substantially reduced. Accordingly, significantly less vacuum is required to hold the sheet material in place against the support surface during the cutting operation than is required with prior art cutters wherein the knife is reciprocated along an attack angle fixed perpendicularly to the cutting path. In many cutting operations where only one or two plys of a relatively heavy sheet material are being cut, no vacuum need be applied to the material to insure that i remains flat against the support surface.

Any deficiency in cutting speed lost by reducing or, eliminating cutting action on the upstroke of the knife is more than offset by the very high speed with which the present reciprocating knife cutter can be operated. Due to its simple construction which eliminates the need for either a flexible knife blade or a connecting rod between the eccentric drive and the knife, the reciprocating cutter of the present invention can operate at speeds of 20,000 rpm or more, which far exceeds the operating speeds of prior art reciprocating cutters. Moreover, cutting efficiency is increased because, as pointed out above, in this particular mode of operation the present cutter does not tend to lift the sheet material from the support surface during the upstroke of the knife.

Contrary to the above-described mode of operation, and as those skilled in the art recognize, there are certain cutting operations and/or types of sheet materials here it is desirable to have the knife cut primarily on its upward stroke. To meet the requirements of such situations, the rotation of the eccentric drive is simply reversed from the direction describe above so that the cutting edge of the knife moves forward with respect to the cutting path during the knife's upward stroke and reward with respect to the cutting Path as the knife moves through its downward stroke.

Preferably, the support means pivotally supports the lower part of the knife for oscillation about a pivot axis disposed parallel to the eccentric drive axis and fixed relative to the frame at a position vertically below the drive axis. Thus, as the upper part of the knife is rotated and the knife reciprocates, the lower part of the knife oscillates about the pivot axis in a plane perpendicular to the eccentric drive axis, and the knife and the support means slide relative to one another along the knife's longitudinal axis.

Regardless of the particular means utilized for supporting the lower part of the knife, it is preferable that the support means be movable with respect to the frame. By changing the position of the support means on the frame, the arcuate trajectory followed by the cutting edge of the knife can be adjusted so that the forward or rearward movement of the cutting edge with respect to the cutting path can be selectively increased or diminished over the degree of movement presented when the support means is located vertically below the eccentric drive axis.

In the-most preferred embodiment of the invention, the means for pivotally supporting the lower part of the knife includes a blade guide carried by the frame for oscillation about the pivot axis. The guide slidably engages the bottom part of the knife, and the two are thereby constrained to slide relative to one another along the knife's longitudinal axis and oscillate together about the guide axis in a plane perpendicular to the eccentric axis as the drive member rotates and reciprocates the knife.

According to a second aspect, the present invention provides an apparatus for cutting single or low ply sheet material. The apparatus includes a table having a penetrable support surface for supporting one or more layers of sheet material in a spread condition, the above-described cutter head for cutting the sheet material, a carriage for mounting the cutter head above the support surface for relative movement therewith in at least two coordinate directions, and means for moving the cutter head and the support surface relative to one another.

According to a third aspect of the invention, a cutting apparatus including a knife sharpener is provided. The apparatus includes a table having a support surface for supporting one or more layers of sheet material in a spread condition, a cutter head including a -knife, a carriage for mounting the cutter head above the support surface for relative movement therewith in at least two coordinate directions, and means for moving the cutter head and the support surface relative to one another. Means for sharpening the knife mounted on at least one of either the table or the carriage are also provided. The means for sharpening the knife includes, for example), a rotating disk or wheel, a driven endless belt, or a strip of abrasive material arranged along one side of the table adjacent the support surface.

DETAILED DESCRIPTION OF THE INVENTION

Figure 1:
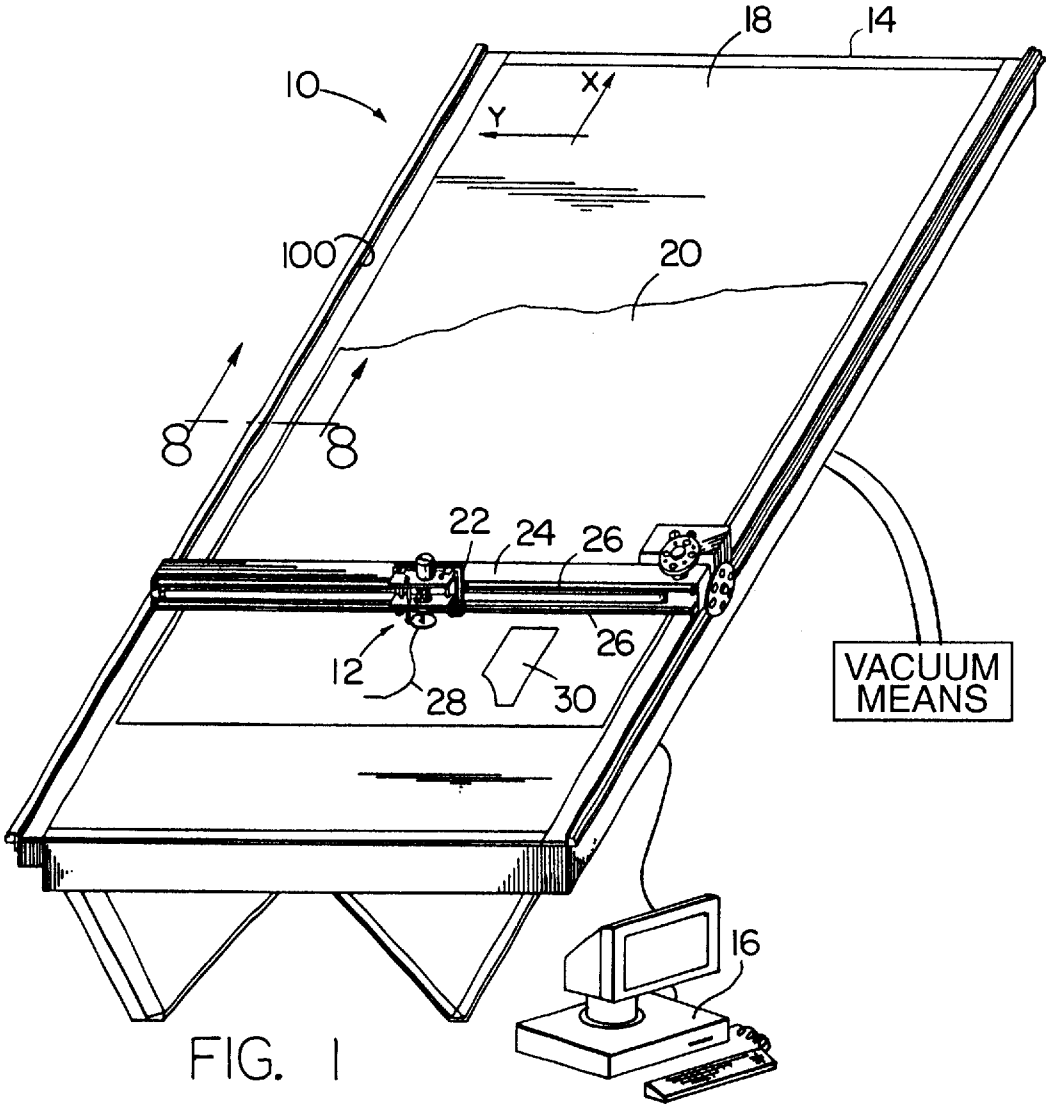
FIG. 1 is perspective view of a cloth cutting apparatus including a reciprocating knife cutter and a knife sharpener embodying the invention.

FIG. 1 shows a cloth cutting apparatus, indicated generally at 10, having a cutter head, indicated generally at 12, embodying the present invention. The cutting apparatus 10, in addition to the cutter head 12, includes a cutting table 14 and a controller 16. The table 14 has a horizontal, upwardly facing support surface 18 for supporting sheet material to be cut in a spread condition. One sheet of such material is shown at 20. A vacuum system which is not shown but which may, for example, be similar to the one disclosed in U.S. Pat. No. 4,587,873 is preferably associated with the table to aide, when needed, in holding the sheet material in place against the support surface during a cutting operation. The material forming the support surface 18 of the table is one which allows the knife of the cutter head to penetrate into it during a cutting operation. This material may vary widely, but preferably it consists of a plurality of bristle elements or blocks fitted together to form a continuous bristled bed, as disclosed in the aforementioned U.S. Pat. No. 4,587,873.

A tool mount 22, which forms a part of the cutter head 12, is supported on an X-carriage. 24 by two guides bars 26, 26, for movement in the illustrated Y-coordinate direction. At each of its opposite ends, the X-carriage 24 is guided for movement relative to the table 14 in the illustrated X-coordinate direction. Suitable drive motors and associated drive trains, under the control of the controller 16, move the tool mount 22 and X-carriage 24. Thus, by combined movement of the X-carriage 24 in the X-coordinate direction and the tool mount 22 in the Y-coordinate direction the cutter head 12 may be made to follow any desired line of cut on the sheet 20 to cut pattern parts or other similar components from the sheet, one such line of cut being indicated at 28 and one such pattern piece being indicated at 30.

It should be understood, that while the cutting table 14 is shown in FIG. 1 as a stationary table, the invention also encompasses a conveyor-type cutting table wherein means are provided for positioning successive, un-cut segments of sheet material beneath the cutter head as a series of cutting operations are performed.

Figure 2:
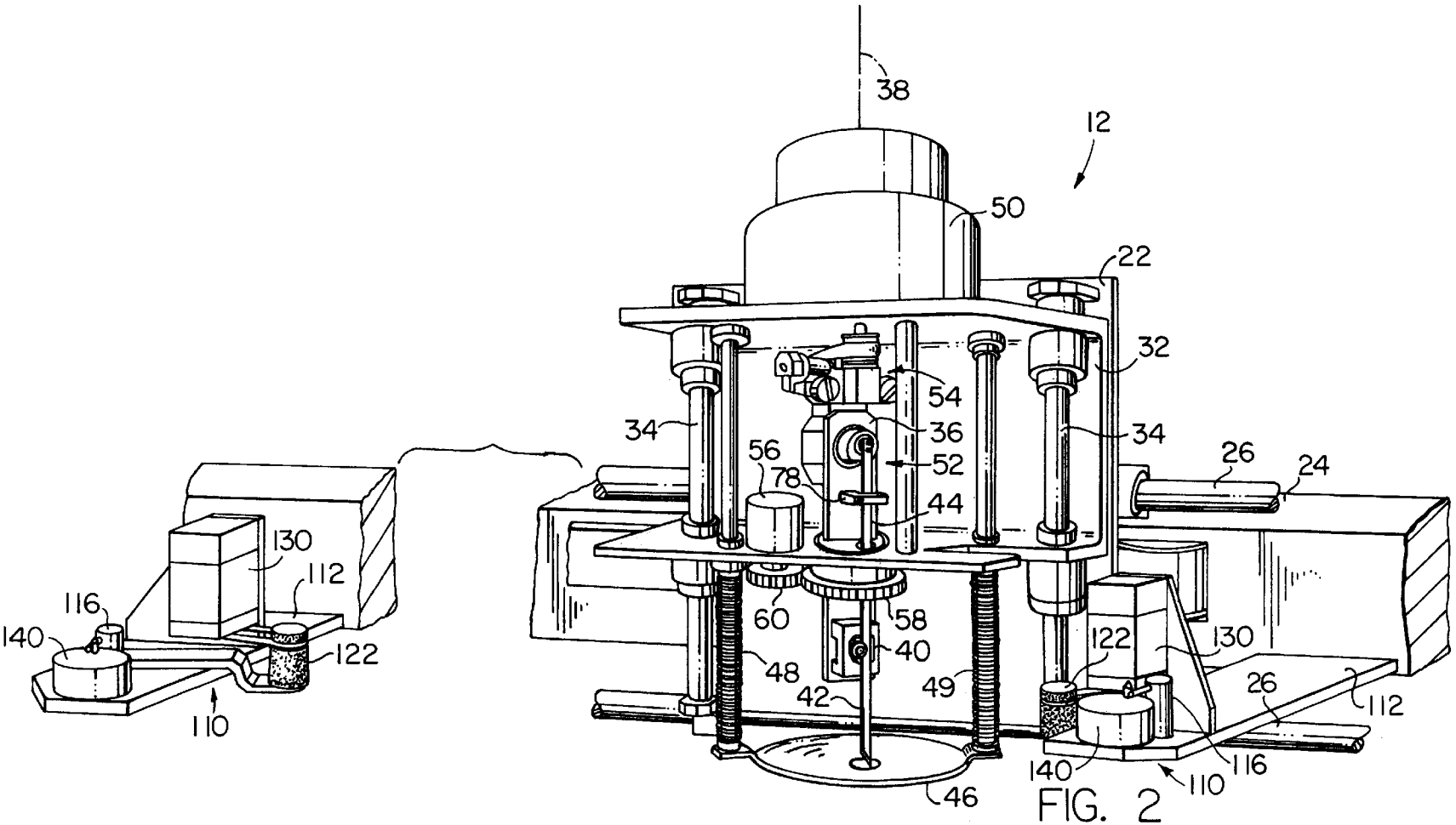
FIG. 2 is a fragmentary enlarged perspective view of a cutter head which forms a part of the apparatus shown in FIG. 1 and which includes a reciprocating knife cutter embodying the invention.
Figure 4:
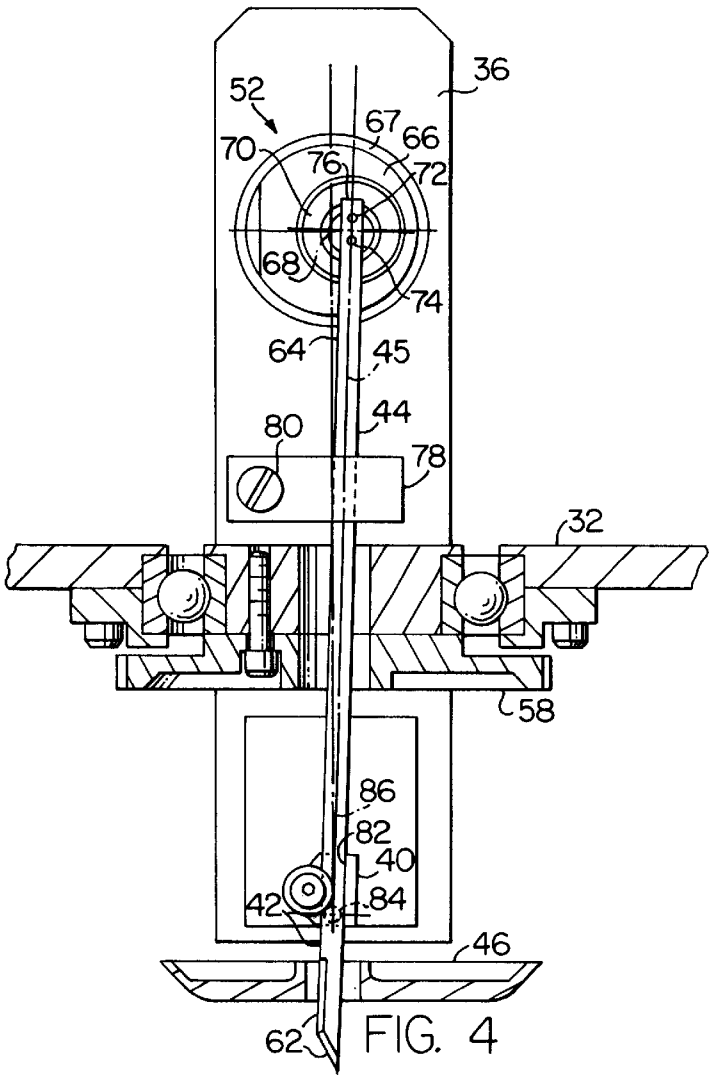
FIGS. 3, 4, 5 and 6 are views partly in elevation and partly in vertical section showing the knife, guide and eccentric drive mechanism of the cutter head shown in FIG. 2, all of these views being identical except for the eccentric drive mechanism being in different positions about its rotational axis.
Figure 3:
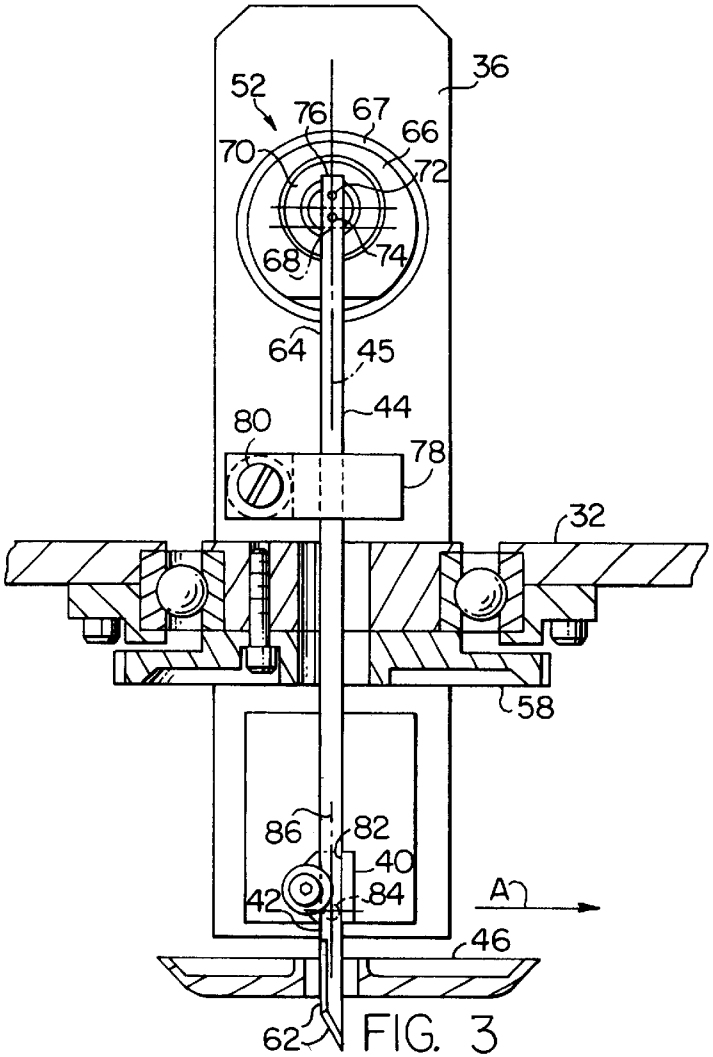
Figure 6:
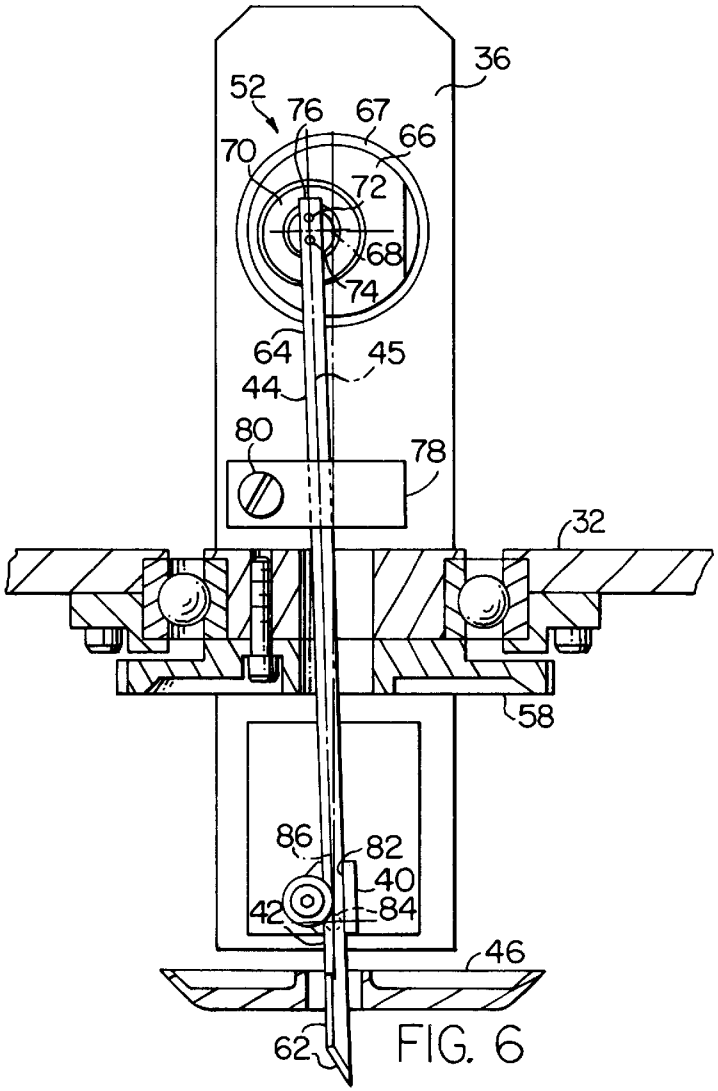
Figure 5:
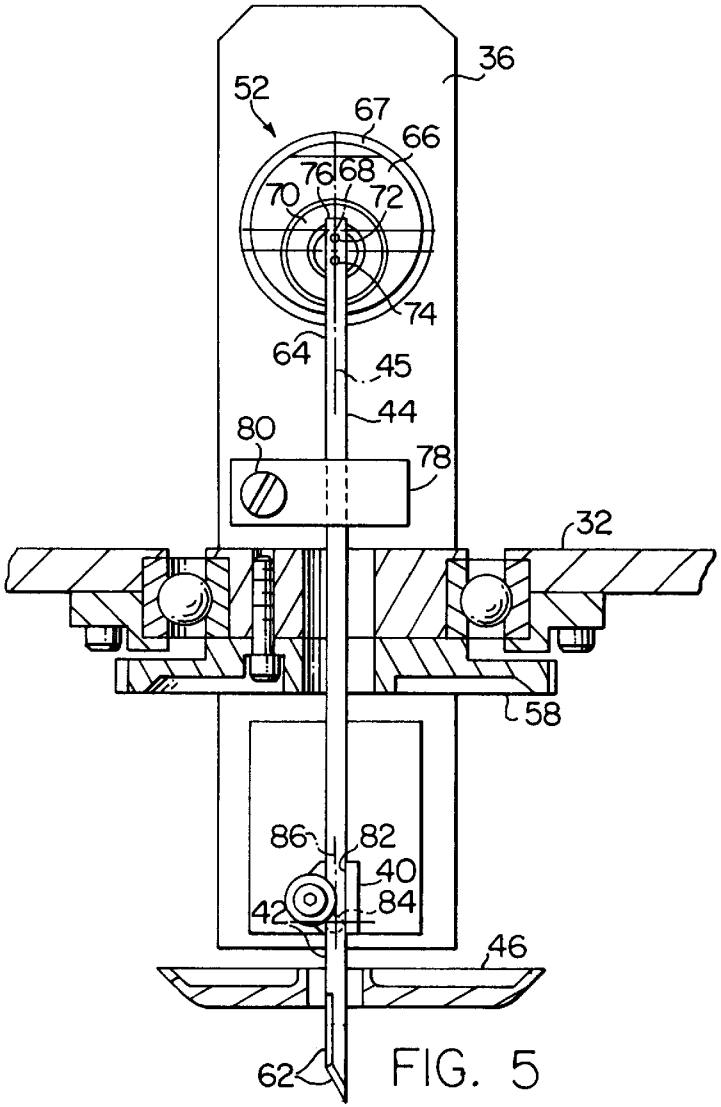

As shown best in FIG. 2, the cutter head 12 includes a base frame 32 supported for vertical movement relative to the tool carriage by guide rods 34, 34. FIG. 2 shows the base frame 32 in its raised or non-cutting position relative to the tool mount 22, from which position it may be lowered by sliding on the rods 34, 34 and by operation of a pneumatic actuator or similar motor (not shown), to a lowered cutting position.

A knife frame 36 is carried by the base frame 32 for rotation relative to the base frame about a vertical axis 38. The knife frame 36 in turn has affixed to it a guide 40 which engages the lower part 42 of an elongated knife 44 and restrains the knife to reciprocating motion along the longitudinal axis 45 of the knife (see FIGS. 3–6), as will be explained more fully below. A presser foot 46 is supported on the base frame 32 for vertical sliding movement relative to the base frame and is biased by one or more springs, such as the springs shown at 48 and 49, to its lowermost position. When the frame 32 is lowered from its FIG. 2 position to a cutting position, the presser foot, after engaging the material to be cut, has its downward movement stopped by the material to be cut so that the base frame 32 thereafter moves downwardly relative to the presser foot against the force of the biasing springs 48, 49 with the knife 44 then moving through the center of the presser 46 and into cutting relationship with the material 20.

The motor 50 for driving the knife 44 is carried by the base frame 32 and is drivingly connected with an eccentric mechanism, indicated generally at 52, carried by the knife frame 36 through a pulley and belt drive train, indicated generally at 54. This arrangement allows the knife frame 36 to rotate about the vertical axis 38 relative to the base frame 32 and motor 50 while, nevertheless, the motor 50 delivers power to) the eccentric drive mechanism 52 at all angular positions of the knife frame about the axis 38. The knife frame 36 is positioned about the axis 38 under the control of the controller 16 and by a motor 56 carried by the base frame 32. The motor 56 is drivingly connected with the knife frame 36 through gears 58 and 60. As those skilled in the art will recognize, the invention is not limited to this arrangement, and, although not illustrated, the motor 50 could have its shaft directly coupled to the eccentric.

Referring now to FIGS. 3–6, the knife 44 has, as mentioned, a lower part 42 which along at least a portion of the length of its forward edge is sharpened to provide a cutting edge 62 for cutting the material 20 as the knife is reciprocated and moved along a line of cut. The knife 44 also includes an upper or drive part 64 which is connected with the eccentric mechanism 52. Preferably, the knife 44 is constructed as a single piece so that when making a knife replacement the entire knife, including both the lower part 42 and the upper part 64, is removed and replaced by a similar new, thin, one-piece knife. The invention is not, however, limited to this particular construction, and in some cases the upper part 64 may be made as a separate member releasably connected to the lower part 42 which forms another separate member, thereby allowing the lower part to be removed and replaced without at the same time removing and replacing the upper part 64.

Turning now to the eccentric mechanism 52 and still referring to FIGS. 3–6, the eccentric mechanism includes a cylindrical crank member 66 rotatably mounted within frame 36 by bearing 67. The crank member 66 is drivingly connected to the pulley and belt drive train 54 for rotation about horizontal eccentric drive axis 68. The eccentric mechanism further includes a bearing 70 carried by the crank member 66 at a position spaced from the eccentric axis 68 so that the bearing has a given eccentricity. Eccentric drive pins 72 and 74 are supported within the bearing 70 so that the pins rotate with the bearing about eccentric drive axis 68 as the crank member is driven by the motor 50.

The drive pins 72, 74 extend outwardly from bearing 70 parallel to the eccentric drive axis 68 and through apertures formed in the upper end 76 of the knife's upper part 64. Thus, the pins are drivingly connected to the knife 44 and reciprocate the knife in a plane perpendicular to the eccentric drive axis as the crank member rotates. Preferably, the upper part of the knife is releasably connected to the pins so that the knife can be easily removed from the cutter head 12 and replaced. In the illustrated embodiment, the apertures are sized so that the knife is simply pressed onto the pins manually. The knife is maintained in engagement with the pins by friction and by a retaining member 78 which is mounted to the knife frame 36 by screw 80 for rotation between a retaining position (illustrated) and a release position (not shown). It is important to note here that in the retaining position, the retaining member 78 is in sliding engagement with the upper part 64 of the knife 44 as the knife is reciprocated. Thus, the retaining member also serves to dampen vibrations that tend to develop in the knife during reciprocation.

As illustrated in the drawings, the guide 40 is located vertically below the eccentric drive mechanism 52 and has a slot 82 formed therein for receiving the, knife 44. The slot 82 is dimensioned such that when the knife is received therein, the guide and knife are in engagement. The knife and guide are constrained by this engagement to slide relative to one another along the longitudinal axis 45 of the knife as the knife is reciprocated. To accommodate this arrangement regardless of the position of the knife during its reciprocation, the guide 40 is pivotally mounted to the knife frame 36 by guide pin 84 for oscillation about pivot axis 86 which extends parallel to eccentric drive axis 68. Thus, as shown in FIGS. 3–6, as the knife is reciprocated in a plane perpendicular to the eccentric drive axis, the guide oscillates with the knife in the same plane so that the knife and guide always slide relative to one another along the knife's longitudinal axis.

From the foregoing description, it will be understood that the knife 44 does not present an attack angle which is perpendicular to the sheet material 20, as is the case with prior art cutters wherein the knife is restricted to reciprocation along a vertical axis. Instead, as the cutter head 12 is caused to move along a line of cut on the sheet material in the direction indicated by arrow A, the cutting edge 62 of the knife follows an arcuate path, wherein during the knife's downward stroke the cutting edge moves and forward with respect to the line of cut, and during the knife's upward stroke the cutting edge moves rearward with respect to the line of cut. Thus, the reciprocating knife accomplishes substantially more cutting of the sheet material on its downstroke when the cutting edge is moving forward with respect to the line of cut than it does on the upstroke when the cutting edge is moving rearwardly with respect to the line of cut. This being the case, the knife's arcuate cutting path significantly reduces the tendency of the knife to lift the sheet material during its upstroke; accordingly, much less vacuum is required to hold the sheet material 20 in place against the support surface 18 during a cutting operation. In some cutting operations, particularly where only one or two plys of heavier sheet materials are being cut, little or no vacuum is required to hold the sheet material in place during the cutting operation.

As mentioned above, there are those cutting operations and/or sheet materials wherein substantially more cutting action on the upstroke of the knife is desired. Accordingly, the action of the knife can be reversed by simply reversing the direction in which the eccentric crank member rotates. In the illustrated embodiment this is accomplished by-reversing the direction of rotation of the motor 50. Thus, as the knife 44 is reciprocated and the cutter head moves along a line of cut, the edge 62 is moved rearwardly with respect to the line of cut on its downstroke and forwardly with respect to the line of cut on its upstroke. When the cutting head is operated in this manner, the cutting edge of the knife cuts the sheet material primarily on its upstroke.

Figure 7:
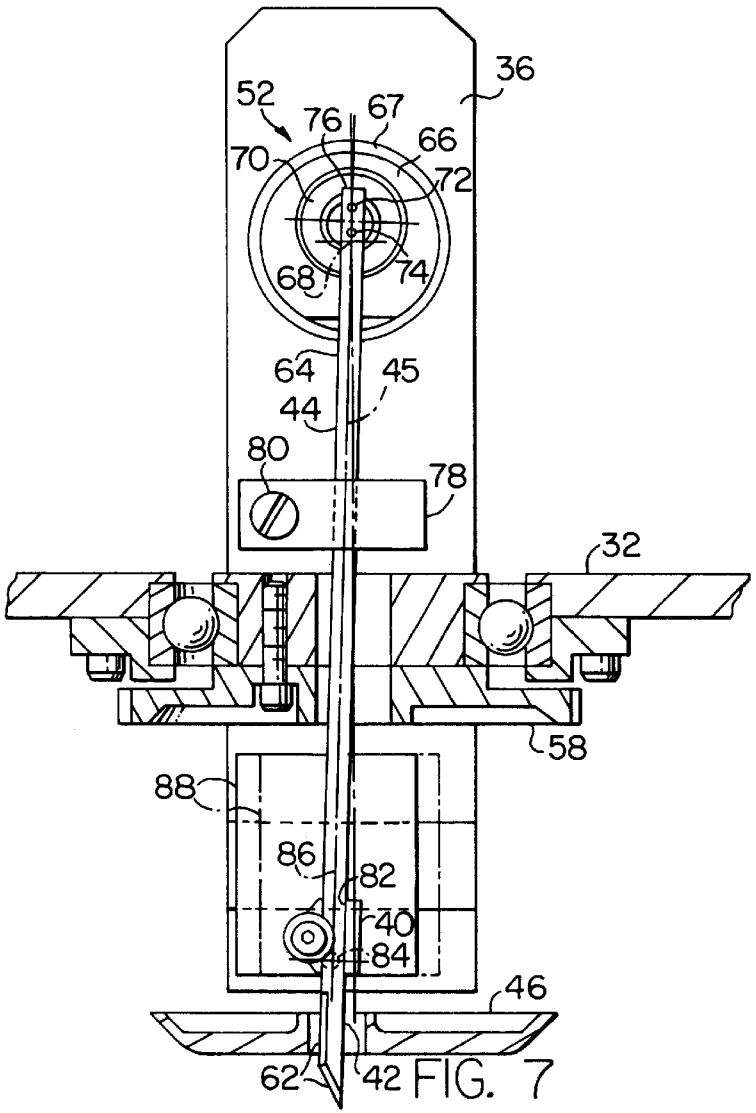
FIG. 7 is a view partly in elevation and partly in vertical section showing a second embodiment of the cutter head shown in FIG. 2.

A second embodiment of a cutter head constructed according to the invention is illustrated in FIG. 7, wherein components corresponding to those comprising the embodiment shown in FIGS. 3–6, have been number identically. As shown in FIG. 7, the guide 40 is pivotably mounted by the pin 84 to a block 88. The block 88 is slidably mounted on the knife frame 36 for horizontal movement with respect to the vertical axis 38 between a first position, which is the position illustrated in FIGS. 3–6 and shown in phantom in FIG. 7, and a second position shown in full-line in FIG. 7. When the block 88 is in the full line position, the pivot axis 86 is no longer located vertically below the eccentric drive axis 68. Accordingly, the cutting edge 62 of the knife is caused to adopt a more perpendicular attack angle with respect to the sheet material on the downstroke of the knife. Conversely the rearward movement of the cutting edge 62 is increased as compared with that provided when the pivot axis is located vertically below the eccentric drive axis.

Of course, the invention is not limited to horizontal movement of the block 88 between the first and second positions illustrated in FIG. 7. In fact, the cutter head 12 is constructed so that the block 88 is moveable horizontally among an infinite number of positions with respect to the vertical axis 38. Thus, the arcuate path of the cutting edge 62 can be precisely adjusted to meet the demands of each particular cutting operation. Of course, further modifications of the arcuate path of the cutting edge can be obtained by constructing the cutter head so that the block 88 may be positioned on the frame at any angle with respect to the vertical axis 38.

As mentioned previously, the present invention also provides a cutting apparatus having a knife sharpener. This aspect of the invention will be described in connection with the cutting apparatus 10. However, it should be understood that the invention is in no way limited in this regard and that this aspect of the invention encompasses cutting apparatus of the general type wherein sheet material is supported on a cutting table during a cutting operation, and a carriage supports a cutting head including a knife above the cutting table for relative movement therewith in at least two coordinate directions.

Figure 8:
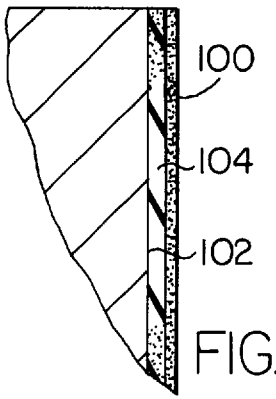
FIG. 8 is a cross-sectional view of a stationary knife sharpener for use with the cutter head shown in FIG. 2.

Referring now to FIGS. 1, 2, 8 and 9, the apparatus 10 further includes a knife sharpener for sharpening the cutting edge 62 of the knife 44. In one embodiment, as shown in FIGS. 1 and 8, the sharpener comprises a strip of abrasive material 100 attached along a vertical side wall 102 of the cutting table 14. The strip 100 is formed from any abrasive material suitable for sharpening the cutting edge 62, such as, for example, sandpaper or abrasive cloth. When sharpening is needed, the cutter head 12 is moved to a position on the X-carriage 24 so that when the base frame 32 is adjusted vertically on the guide rods 34, 34, the cutting edge of the knife contacts the abrasive strip 100. The X-carriage is then moved in the X coordinate direction along the table 14 while the knife is reciprocated to achieve the desired sharpening.

The abrasive strip 100 must be provided with sufficient resiliency to prevent damage to the knife 44 and/or the cutter head 12 as the knife is pressed against the strip during sharpening. Accordingly, as shown in FIG. 8, a layer of foam 104 or other resilient material is mounted on the vertical wall 102 beneath the abrasive strip 100. For example, the foam layer 104 is adhesively mounted on the wall 102, and the abrasive strip 100 is adhesively attached to the foam layer. Thus, as the knife is moved along the strip 100 and is reciprocated against it, the foam layer 104 compresses and provides the required resiliency. Of course, reciprocation of the knife 44 while in contact with the abrasive strip 100 is not required. As those skilled in the art will recognize, simple linear movement of the knife in contact with the strip provides sufficient abrasion for sharpening.

In a second embodiment of such a sharpener, the X-carriage is held stationary and the strip 100 is oscillated back and forth in contact with the knife 44 to effect sharpening. This is accomplished, for example, by providing a rigid backing which supports the foam layer 104 and the abrasive strip 100 and coupling the backing to a vibrator which is mounted on or within the vertical side wall 102. In such an arrangement, the knife remains stationary as the strip is oscillated, or sharpening may be accomplished by combined oscillation of the strip 100 and reciprocation of the knife 44.

Alternatively, the strip 100 is provided as an endless abrasive belt which is advanced by suitable drive pulleys and a drive motor mounted on the side wall 102. As in the above embodiment, the knife remains stationary as the strip is oscillated, or sharpening may be accomplished by combined movement of the abrasive belt and reciprocation of the knife 44.

In order to reduce down time of the apparatus 10, the cutting edge 62 is sharpened between cutting operations as a fresh piece of the sheet material 20 is placed in a spread condition on the support surface 18, or when necessary. In the case of a conveyorized cutting table, additional sharpening is accomplished as the conveyor moves an un-cut segment of the material in place beneath the cutter head between successive cutting operations.

Figure 9:
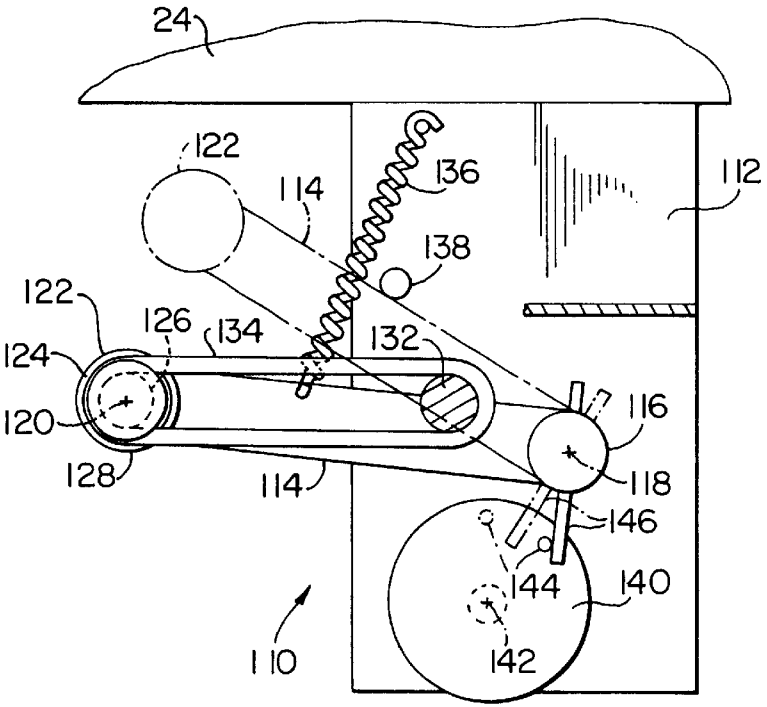
FIG. 9 is a top plan view of a second knife sharpener for use with the cutter head shown in FIG. 2.

FIGS. 2 and 9 illustrates a second embodiment of a stationary knife sharpener, wherein the sharpener is mounted on the X-carriage 24. In the illustrated embodiment a sharpener is mounted on both ends of the X-carriage; however, the invention encompasses an arrangement wherein a sharpener is mounted on one end of the carriage. The sharpener, generally designated 110, is mounted on a support bracket 112 extending horizontally from the X-carriage. The sharpener includes an arm 114 rigidly fixed to a hub 116 supported on the bracket 112 for rotation about a vertical axis 118. Supported on the outer end of the arm 114 for rotation relative to it about a second vertical axis 120 is a sharpening wheel 122 consisting of a body 124 having a drive groove 126 intermediate its top and bottom ends and an abrasive grit 128 bonded to the outer surface of the body. The sharpening wheel is driven in rotation about the second vertical axis 120 by a motor 130 through a pulley 132 and an O-ring drive belt 134 engaging the wheel's drive groove 126.

A tension spring 136 normally holds the arm 114 in a retracted position against a stop 138 as shown in the broken lines of FIG. 9. From this position, the arm is moveable to an active sharpening position shown by the solid lines of FIG. 9, in which the sharpening wheel is brought into engagement with the cutting edge 62 of the knife 44. To effect this movement of the arm 114, the sharpener 110 further includes a rotary solenoid actuator 140 having an output member rotatable about a vertical axis 142 and carrying a vertically extending pin 144. When the solenoid is de-energized, the pin 144 is biased by an internal spring (not shown) to the position shown by the broken lines in FIG. 9. When the solenoid is energized, the pin rotates clockwise about the axis 142 from the broken line position to the full line position illustrated in FIG. 9. In the course of this movement the vertical pin 144 engages a horizontal pin 146 fixed to the hub 116 thereby rotating the arm 114 from its retracted to its active position.

During a sharpening operation, which preferably takes place between cutting operations, the controller 16 directs the cutter head 12 to a position on the X-carriage adjacent the sharpener 110, and, if required, the base frame 32 is adjusted vertically on the guide rods 34, 34 to the appropriate position. The blade 44 is then rotated by the motor 56 to the proper position about the axis 38 for sharpening and the sharpening wheel 122 is brought into contact with the cutting edge 62 by swinging the arm 114. As shown in FIG. 2, the spring 49 is positioned closer to the base frame 32 than spring 48 to accommodate the swinging of the arm 114 to its active position. During sharpening, the wheel 122 is rotated while the knife 44 is reciprocated to insure that the sharpening wheel engages the full extent of the cutting edge 62.

While preferred embodiments have been shown and described, various modifications and substitutions may be made without departing from the spirit and scope of the invention. For example, the sharpener 110 could be mounted on either or both of the vertical end walls of the cutting table 14. Those skilled in the art will readily appreciated that to perform a sharpening operation with such an arrangement, the controller 16 directs the X-carriage to the appropriate end of the table and directs the cutter head 12 to a location on the carriage so that the sharpening wheel 122 contacts the cutting edge 62 of the knife 44 when the wheel is swung into its active position. The wheel is then rotated and the knife reciprocated, as described above, to effect sharpening of the cutting edge. Accordingly, it is to be understood that the present invention has been described by way of example and not by limitation.

I claim:

1. An apparatus for cutting sheet material, comprising:

a table having a generally horizontal and rectangular four sided support surface extending in X and Y coordinate directions for supporting one or more layers of sheet material in a spread condition, said table having a vertical side wall extending in one of said X and Y coordinate directions and located adjacent one of said four sides of said support surface;

an X-carriage carried by said table, said X-carriage spanning said support surface in the Y coordinate direction;

X moving means for moving said X-carriage in said X-coordinate direction relative to said support surface;

a cutter head supported on and movable relative to said X-carriage in the Y coordinate direction, said cutter head including an elongated knife having a longitudinal axis generally perpendicular to said support surface and reciprocable along said longitudinal axis;

Y moving means for moving said cutter head in said Y coordinate direction relative to said X-carriage; and a knife sharpener for sharpening said knife, said knife sharpener comprising an elongated strip of abrasive material having a longitudinal dimension and fixed to said vertical sidewall of said table with said longitudinal dimension of the strip extending parallel to one of said X-coordinate and Y-coordinate directions so that said strip of abrasive material is normally located remotely from said knife at one side of said support surface and is not supported directly by the cutter head with said longitudinal dimension parallel to said one side of said support surface;

said knife being movable into and out of engagement with said strip of abrasive material at different points along said longitudinal dimension by combined movement of said X-carriage in said X coordinate direction by said X moving means and movement of said cutter head in said Y coordinate direction by said Y moving means, so that after having been brought into engagement with said strip said knife may be sharpened between cutting operations by engagement with said strip.

2. The apparatus of claim 1 wherein said strip of abrasive material is resiliently fixed to said side wall by a strip of resilient material located between side wall and said strip of abrasive material.

* * * * *